United States Patent [19]

Beeloo

[11] Patent Number: 4,504,190

[45] Date of Patent: Mar. 12, 1985

[54] FLOW CONTROL APPARATUS AND METHOD

[75] Inventor: Leendert A. Beeloo, Venice, Calif.

[73] Assignee: Gas Power Systems, Inc., Cerritos, Calif.

[21] Appl. No.: 473,747

[22] Filed: Mar. 9, 1983

[51] Int. Cl.[3] ..... F01D 17/16

[52] U.S. Cl. ..... 415/166

[58] Field of Search ..... 415/159, 161, 164, 166, 415/1, 165

[56] References Cited

U.S. PATENT DOCUMENTS

| | | | |
|---|---|---|---|
| 2,648,195 | 8/1953 | Wilde et al. | 415/161 UX |
| 3,162,421 | 12/1964 | Schwarz | 415/161 X |
| 3,232,581 | 2/1966 | Swearingen | 415/147 |
| 3,495,921 | 2/1970 | Swearingen | 415/163 |
| 4,242,040 | 12/1980 | Swearingen | 415/163 X |
| 4,300,869 | 11/1981 | Swearingen | 415/160 |
| 4,338,063 | 7/1982 | Nakanishi | 415/164 |

FOREIGN PATENT DOCUMENTS

| | | | |
|---|---|---|---|
| 91931 | 5/1897 | Fed. Rep. of Germany | 415/166 |
| 820429 | 9/1951 | Fed. Rep. of Germany | 415/159 |
| 900372 | 11/1953 | Fed. Rep. of Germany | 415/161 |
| 908047 | 10/1962 | United Kingdom | 415/161 |

*Primary Examiner*—Robert E. Garrett
*Assistant Examiner*—Joseph M. Pitko
*Attorney, Agent, or Firm*—F. Eugene Logan

[57] ABSTRACT

Disclosed are apparatuses for controlling the flow of fluids which comprise a plurality of identical nozzle means arranged in an axially symmetrical configuration on a stator means and defining a plurality of identical flow channels or passageways. Each nozzle means comprises a fixed-spacer member and an adjustable-segment member. The fixed-spacer members are sealably fixed to the stator and mandate that the fluid flows through the flow channels. The adjustable-segment members are slideably connected to the fixed-spacer members in an essentially sealing relationship. Adjustable-segment members are operable to move only in straight-line direction and are not permitted to move pivotally. Jar-free movement of the adjustable members is possible regardless of flow or pressure of fluid. An essentially constant angle of discharge is possible for all adjustable positions of the nozzle means thereby enabling a high operating efficiency of the apparatus over a wide range of operating conditions.

18 Claims, 5 Drawing Figures

FLOW CONTROL APPARATUS AND METHOD

BACKGROUND OF THE INVENTIONS

The present invention pertains to methods and apparatuses for providing fluid control for fluid-handling rotary machinery, and more particularly, to apparatuses such as turboexpanders and compressors. Such apparatuses, typically, include a rotor having a series of fluid passageways therethrough, each passageway having one end open radially outwardly of the rotor. A stator, generally, surrounds the rotor and supports a number of nozzles communicating with the radially openings of the rotor passageways. Such nozzles are commonly provided on turboexpanders for injecting fluids into such rotor passageways. The nozzles, typically, are defined by a number of blades pivotally mounted on the stator. In order to provide for adjustment of the blade angle, and to close the opening between the blades, a clamping ring is, typically, provided for adjusting the blades. Frequently, the clamping ring is connected to the blades by a cam mechanism such as pin and slot arrangements, so that, upon rotation of the clamping ring, the angle of the blades can be varied.

It is desirable, in order to improve the efficiency of such apparatuses, that the fluid flow only in the channels or passageways between the nozzles. Fluid which flows outside such channels is called leakage. The greater the leakage the less efficient is the apparatus. Leakage in such apparatus, typically, occurs between the blades and the stator, and between the blades and the clamping ring or blade adjusting ring.

Accordingly, some prior art devices have utilized the pressure differential between the inlet and outlet to the device to urge the clamping ring against the nozzle blades to prevent leakage. Indentations or grooves in the nozzle blades and/or clamping ring have been used in such prior art devices to relieve, to some extent, the force on the clamping ring against the blades in order to facilitate the movement or adjustment of the blades.

It has been found, however, that such prior art devices are not capable of preventing leakage over a wide variety of flows and/or pressures of the fluid. It has also been found that such prior art devices are not capable of smooth adjustment, or fine tuning, or jar-free movement of the blades over a wide range of flow and/or pressure of the fluid.

Furthermore, and even more importantly, in many prior art devices the efficiency of such device is only relatively high for a very narrow range of operating conditions, i.e. flow rate and/or pressure. As such apparatuses are adjusted for fluid conditions which lie outside such narrow ranges, the efficiency of such apparatuses decrease drastically. This is, typically, a result of the pivotal movement of the blades to accomodate for the change in fluid flow conditions. In particular, the pivotal movement of the blades, typically, prevents the blade from presenting an optimum discharging angle or entry angle to or from the nozzle as the case may be. For example, in a turboexpander, such pivotal movements of the blade frequently alters the angle into-the-rotor in such a manner that the operating efficiency of the turboexpander is greatly reduced. This loss of efficiency is in addition to any additional loss of efficiency due to leakage.

There is a need therefore, for a flow control apparatus for fluid-handling rotary machinery which prevents or substantially minimizes the leakage of fluid around the nozzle blades of such devices over a wide range of flow rates and/or pressures. There is also a need for a flow control apparatus which is capable of maintaining a highly efficient nozzle configuration over a wide range of fluid flow rates and/or pressures.

Various embodiments of the present invention are designed to overcome many of the disadvantages found in the prior art devices.

SUMMARY OF THE INVENTION

It is an object of this invention to provide for an improved flow control apparatus for a fluid-handling rotary machine.

It is also an objective of one embodiment of this invention to provide an improved turboexpander having adjustable blades or nozzle means.

It is another objective of this invention to provide an improved turboexpander having adjustable nozzle elements which is also highly efficient for energy recovery over essentially positions of adjustments of the blade or nozzle elements.

It is another object of one embodiment of this invention to provide turboexpander which is highly efficient over a wide range of working fluid flow rates and pressures.

It is also an objective of one embodiment to provide a turboexpander which can be adjusted to essentially zero flow rate or which can be adjusted to essentially stop the flow of the working fluid into the wheel or rotor. It is also an objective in one embodiment to be able to adjust the flow of the working fluid into the rotor from a maximum value to essentially zero.

It is also an objective of this invention to provide an improved turboexpander which essentially prevents or totally prevents leakage of the working fluid by the nozzle elements, and thus in so doing essentially eliminates or totally eliminates loss of expander efficiency as a direct result of leakage regardless of the position of the adjustable nozzle blades.

In another embodiment it is an objective to essentially prevent or totally prevent leakage of the working fluid by the blade elements and essentially eliminate or totally eliminate loss of expander efficiency as a direct result of leakage by the blades regardless of the flow or pressure of the working fluid.

It is also an objective of this invention to provide a turboexpander having nozzle means which comprises two members per nozzle means, wherein one member of each nozzle means is fixed and one member of each nozzle means is adjustable.

It is a further objective of another embodiment to have the adjustable member of each nozzle means be adjustable solely by straight-line movement of the adjustable member and not by pivotal movement thereof.

It is also an objective of one embodiment to have the trailing edge of a nozzle element formed by the fixed member. In a further embodiment it is an objective to provide a constant angle of entry of the working fluid into the rotor regardless of the position of the adjustable members of the nozzle means.

It is also an objective of one embodiment of this invention for the nozzle means to form a constant discharge angle regardless of the position of the adjustable members of the nozzle means.

It is another objective of an embodiment to be able to position the adjustable members of the nozzle means by positive actuation without binding of the adjustable member during its movement or adjustment regardless of the flow or pressure of the working fluid. It is a further objective of a further embodiment to be able to effect such adjustment or movement of the adjustable member in a jar-free movement regardless of the flow or pressure of the working fluid.

It is an objective of one embodiment of this invention to enable the working fluid to flow over the adjustable nozzle means with a minimum formation of turbulent wakes or eddies created by the configuration of the nozzle means over substantially the full range of its adjustments, especially down stream of the trailing edge of the nozzle means. It is an objective in a further embodiment to provide a steady flow substantially free of turbulent wakes formed by the trailing edges of the nozzle elements.

These objectives and other objectives of the various embodiments of this invention are further described below.

More specifically, the present invention comprises a flow control apparatus for a fluid-handling rotary machine comprising a stator means which comprises a first and a second coaxial member, and a plurality of identical nozzle means arranged in an axially-symmetrical configuration on the stator means. The nozzle means are spaced uniformly apart so as to form a plurality of identical flow channels or passageways between the nozzle means. Each nozzle means comprises a fixed-spacer member and an adjustable-segment member. The fixed-spacer members are tightly fastened to, and longitudinally spaced between, the first and second coaxial members in sealing relationship thereto such that when the apparatus is in use, no fluid is allowed to flow radially between the abutting surfaces of the fixed-spacer member and the first coaxial member nor between the abutting surfaces of the fixed-spacer member and the second coaxial member. The fixed-spacer member has a longitudinally extending surface. The adjustable-segment member has a corresponding longitudinally extending surface which abuts the longitudinally extending surface of the fixed-spacer member such that the adjustable-segment member is operable to move in a straight-line direction, which is at least partially radial, and preferably, partially radial and circumferential, but which is inoperable to move pivotally. By inoperative to move pivotally is meant that the adjustable-segment member is inoperable to move in a rotating or pivotal movement relative to the fixed-spacer member.

The adjustable-segment member is abutted against the fixed-segment member in such a manner that said members are in essentially sealing relationship such that when the apparatus is in use essentially no fluid flows radially between the corresponding longitudinally extending surfaces of the members of the nozzle means. The apparatus further comprises a means for adjusting the position of the adjustable-segment members relative to the fixed-segment members.

In one embodiment of the apparatus the fixed-spacer member is spaced radially inward relative to the adjustable-segment member. In such an embodiment the nozzle means forms a discharge angle for fluid entry into a rotor. Such discharge angle remains essentially constant for all adjustable positions of the adjustable-segment member.

In one embodiment of this invention the fluid-handling rotary machine is a turboexpander.

Another embodiment of this invention is a fluid-handling rotary apparatus which comprises a plurality of identical nozzle means each of which comprises a fixed-spacer member and an adjustable-segment member. The fixed-spacer member is originally fastened to and sandwiched in abutting relationship between an outer cover plate and an inner cover plate. Generally, such cover plates have radially extending parallel surfaces spaced longitudinally apart, with the nozzle means located in such space. When such apparatus is in use essentially no flow of fluid is permitted to occur between the abutting surfaces of the fixed-spacer member with the outer and inner cover plates. A means is also provided for adjusting the position of the adjustable-segment member relative to the fixed-spacer member such that the adjustable-segment member is moveable in a straight-line direction without any pivotal movement.

In another embodiment of this invention the adjustable-segment member can be adjusted over its full range of positions in a jar-free movement regardless of the flow or pressure of the working fluid. In an embodiment of this invention designed for a turboexpander, the apparatus is designed for an entry fluid pressure to the apparatus of between about 50 and about 3000 psig, and a discharge fluid pressure from the turboexpander of between about atmospheric and about 1500 psig. This embodiment of the invention is useful for instance in recovering energy from a stream of high pressure natural gas, formed to separate higher molecular weight components from such gas.

In another embodiment of this invention the apparatus is especially designed for a turboexpander having an entry a fluid pressure to the turboexpander of between about 100 and about 1000 psig, and a discharge fluid pressure from the turboexpander of between about atmospheric and about 500 psig. This embodiment of the invention is particularly useful in recovering energy from a pressure reduction stage attached to a natural gas pipe line.

In order to provide for a smooth and controllable or jar-free movement of the adjustable-segment members over a wide range of fluid flow rates and pressures, while at the same time preventing or essentially preventing leakage of fluid between the adjustable-segment member and the abutting surfaces of coaxial members of the stator means, the thickness of the adjustable-segment member is made slightly less than the thickness of the fixed-spacer member. Since the fixed-spacer member is rigidly fastened to such abutting coaxial plates the clearance between the adjustable-segment members and the coaxial plates remains constant for all fluid flow rates and pressures. In one embodiment the thickness of the adjustable-segment member is between about 0.0001 and about 0.001 inches smaller than the corresponding thickness of the fixed-spacer members. In a prefered embodiment the thickness of the adjustable-segment member is about 0.0002 inches smaller than the thickness of the fixed-spacer member.

In one embodiment of this invention the adjustable-segment members can be adjusted to essentially stop the flow of the working fluids through the nozzle means. In a further embodiment such adjustment to zero flow control is achieved while forming an essentially constant angle for the fluid to enter the rotor over all positions of the adjustable-segment member including the full flow position and the essentially zero flow position by so doing the angle into-the-rotor may be predetermined to obtain the highest operating efficiency of the apparatus. In another embodiment of the discharge angle, formed by opposing surfaces of adjacent nozzle means, remains constant or essentially constant over the entire range of adjustment of the adjustable-segment means thereby permitting highly efficient energy recovery.

DESCRIPTION OF THE PREFERRED EMBODIMENTS

Referring to the Figures, there is provided a stator and nozzle means for a turboexpander assembly representing a typical type of fluid-handling rotary apparatus or application of the present invention. However, the present invention could be applied to other types of turbines and to compressors, as well as to other kinds of rotary mechanisms.

The rotor or wheel of the turboexpander, which is not shown in the Figures, would be positioned radially inwardly of the nozzle means, elements 10 and 12.

In general, such fluid-handling rotary devices such as turboexpanders consist of a rotor and a stator. The rotor (not shown) is mounted on a shaft (not shown) which in turn is mounted in a suitable bearing (not shown) for rotation about axis 14. The rotor has a plurality of fluid passageways 15 therethrough. The inlet of the rotor passageway (not shown) opens generally radially into the outer axial extremity (not shown) of the rotor. Typically, the passageway in the rotor gradually changes the direction of the fluid flowing therethrough so that fluid received from the nozzle means of the present invention enters the rotor with rotational and radially inwardly flow direction whereupon it is converted to a generally axially outward flowing direction along axis 14.

Figure 1:
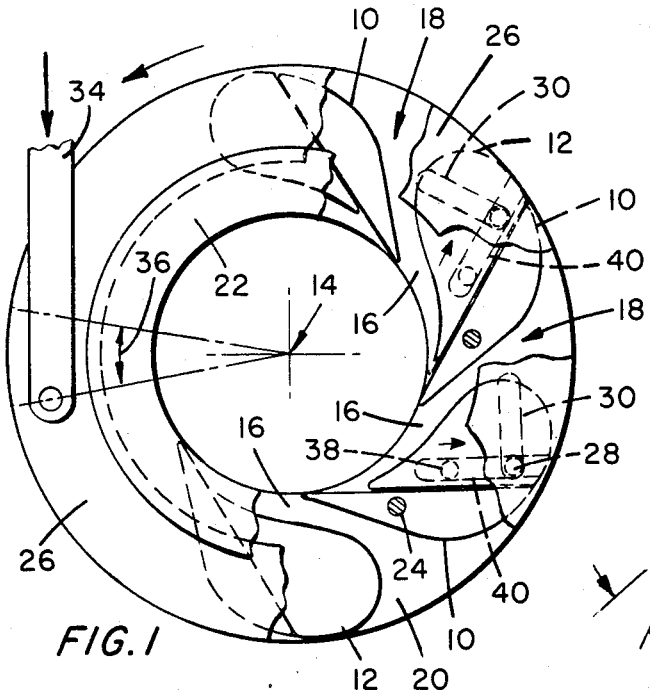
FIG. 1 is a partial plain view of a stator and adjustable nozzle means for a turboexpander showing an embodiment of the present invention in which the adjustable-segment members are in the maximum flow position.
Figure 2:
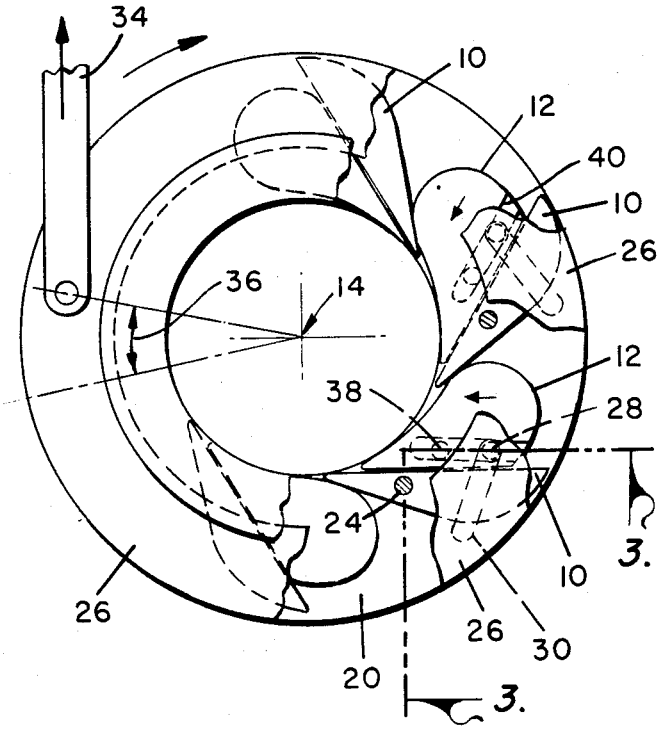
FIG. 2 is a partial plain view of the stator and nozzle means of FIG. 1 wherein the adjustable-segment members have been adjusted to essentially zero flow.

Referring to FIG. 1, which shows a subassembly of a turboexpander, there is provided a plurality of identical nozzle means which comprise fixed-spacer members 10 and adjustable-segment members 12. Opposing nozzles, more specifically a fixed-spacer member 10 of one nozzle means which opposes adjustable-segment member 12 of an adjacent nozzle means, form a plurality of identical flow channels or passageways 16 through which a fluid flows in the direction as shown by arrow 18. Fixed-spacer members 10 are fixed to annular stator member 20 by means of annular stator member 22 and bolts 24. Adjustable-segment members 12 are adjustably connected to partially rotatable annular ring 26 by means of pins 28 and slots 30. Ring 26 contains slots 30 which in conjunction with pins 28 is operable to adjust the position of adjustable-segment members 12 relative to fixed-spacer members 10. Ring 26 is partially rotatable with respect to stator members 20 and 22 by adjusting rod 34. By moving adjusting rod 34 to its downward extreme position, as shown in FIG. 1, the nozzle means are positioned in their full-open position, and by moving rod 34 to its upward extreme position, as shown in FIG. 2, the nozzle means are positioned in their closed position which essentially stops the fluid flow through the turboexpander. Thus, annular ring 26 is partially rotatable through angle 36. The adjustable means, which comprises adjustable-segment members 12, ring 26, pins 28, slots 30 and rod 34, as well as straight-line movement control means pins 38 and slots 40, is such that no pivotal movement of adjustable-segment member 12 relative to fixed-spacer member 10 is permitted or possible. Thus, adjustable-segment member 12 moves only in a straight-line relationship relative to its corresponding fixed-spacer member 10.

Figure 4:
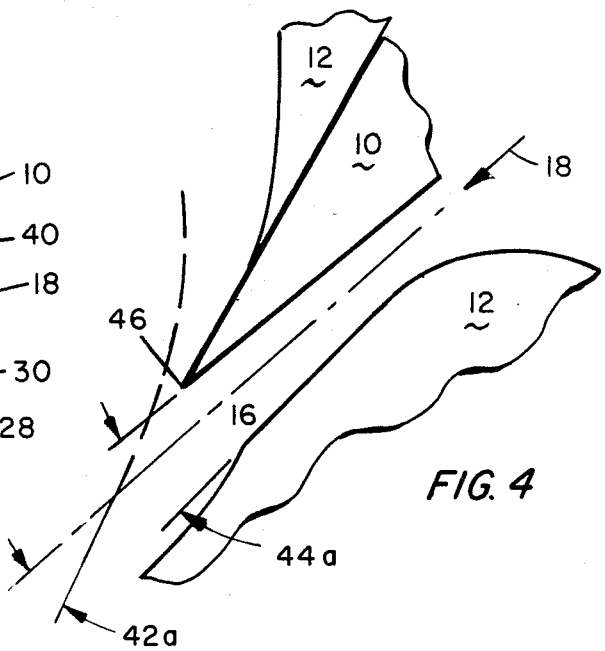
FIG. 4 is an enlarged view of the flow channel or passageway between two opposing nozzles of FIG. 1.
Figure 5:
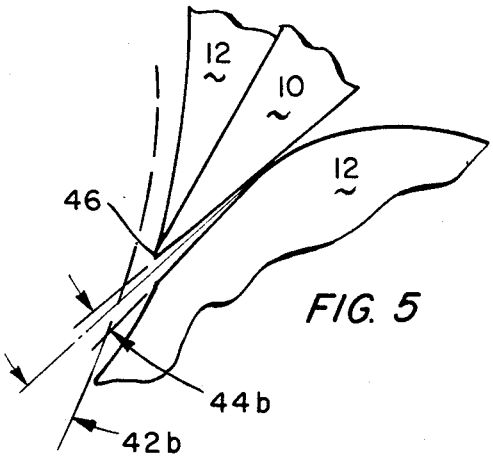
FIG. 5 is an enlarged view of FIG. 2 showing an essentially closed flow channel or passageway between two opposing nozzles.

Furthermore, as can be seen from enlarged views of FIGS. 4 and 5, the angle into-the-rotor formed by the nozzle means is essentially constant over the entire range of adjustment of the nozzle means. The angle into-the-rotor is shown as angles **42*a* and 42*b* in FIGS. 4 and 5 respectively. Furthermore, the discharge angle of the fluid from the nozzle means remains essentially constant over the entire range of adjustment of the nozzle means as can be seen from discharge angles 44*a* and 44*b* shown in FIGS. 4 and 5 respectively. Furthermore, the trailing edge 46 of fixed-spacer members 10 remains at a constant distance and a constant orientation for all adjusted positions of the nozzle means thereby permitting both the angle into-the-rotor 42, and the discharge angle 44** of the fluid from the nozzle means, to be provided at optimum values, predetermined from the design point and the range of fluid flow rates and pressures for which the turboexpander is to be used. This enables, for example a turboexpander or other fluid-handling machinery to be designed for maximum efficiency.

In an experimental test conducted using a commercial turboexpander unit, natural gas having an inlet pressure of 990 psia, a temperature of 31 50° F., an average molecular weight of 17.5 was expanded in a turboexpander having six nozzles, i.e. six pairs of adjustable-segment and fixed-spacer members. Discharge conditions from the turboexpander were 425 psia at −104° F., and 43.39 MMSCFD and 83,510 lbs/hr. The pressure at the outlet of the nozzle was 655 psia. The turboexpander drove a compressor having an inlet pressure of 412 psia, a temperature of 92° F. of natural gas having an average molecular weight of 16.5. Fluid outlet conditions from the compressor were 506 psia, 126° F., 46.39 MMSCFD, and 84,260 lbs/hr. These and other measured parameters are given in Table 1.

In this experimental test a compressor was used as the driven machine. Other devices, of course, could be used as the driven machine, for example, a generator. Referring to the Table, the first column pertains to the driving machine, which in this case was a turboexpander, and the second column the driven machine which in this case was a compressor. ΔHS is the change in heat content of the fluid. $Z_1$ represents the compressibility of the fluid entering the machine. $Z_2$ represents the compressibility of the fluid discharged from the machine. Efficiency is expressed as a percent of theoretical efficiency. HP (rotor) is the horsepower of the rotor. HP (shaft) is the horsepower of the shaft which is lower than HP (rotor) because of bearing friction losses. TIP (speed) is the speed of the outer extremity of the rotor. The amount of liquid in the outlet natural gas stream due to the cooling is expressed as a percent by weight of the total discharged stream from the turboexpander. In an actual commercial use, the turboexpander could be a part of a methane purification process used to remove higher molecular weight hydrocarbons from natural gas.

Figure 3:
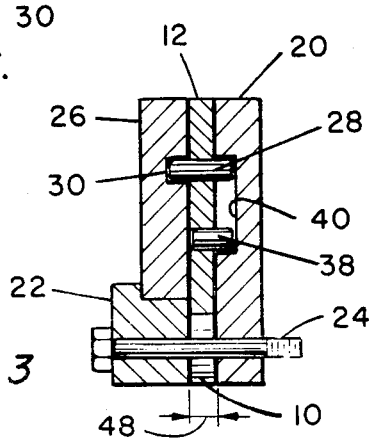
FIG. 3 is a partial cross-sectional view of the stator and nozzle means of FIG. 1.

In this experiment, the thickness of the nozzles, i.e. dimension 48 shown in FIG. 3 was 0.485 inches. The maximum area through the throats of the nozzles was 1.45 square inches. The design area was 1.05 square inches. This represents a maximum nozzle throat opening of 0.498 inches.

The foregoing disclosure and description of the present invention is illustrative and explanatory thereof, and various changes in the method steps as well as in the details of the illustrated apparatus may be made within the scope of the appended claims without departing from the spirit of the invention. For example, in one embodiment (not shown in the FIGS.) the fixed-spacer member can be positioned radially outward of the adjustable-segment member if desired.

TABLE

| | driving machine turboexpander | driven machine compressor |
|---|---|---|
| Fluid | natural gas | natural gas |
| Molecular Weight | 17.5 | 16.5 |
| $P_1$ - inlet (psia) | 990. | 412. |
| $T_1$ - inlet (°F.) | −50. | 92. |
| $P_2$ - outlet (psia) | 425. | 506. |
| $T_2$ - outlet (°F.) | −104. | 126. |
| Flow | | |
| (MMSCFD) | 43.39 | 46.39 |
| (lbs/hr.) | 83,510. | 84,260. |
| ΔHS (Btu/lb) | 23. | 13.35 |
| $ACFM_1$ | 210. | 1158. |
| $ACFM_2$ | 477. | 1005 |
| $Z_1$ | 0.57 | 0.95 |
| $Z_2$ | 0.67 | |
| RPM | 40,000. | 40,000. |
| Outer diameter of rotor (inches) | 4.125 | 5.2 |
| Efficiency (%) | 83. | 74. |
| HP (rotor) | 626. | 598. |
| HP (shaft) | 598. | |
| TIP (speed) (ft/sec) | 720. | 910. |
| Liquid Weight % | 20. | |
| Turboexpander | | |
| No. of Nozzles | 6. | |
| Width (inches) | 0.485 | |
| Max. Area ($in^2$) | 1.45 | |
| Design Area ($in^2$) | 1.05 | |

Subscripts: 1 refers to inlet, 2 refers to outlet.

What is claimed is:

1. A flow control apparatus for a fluid-handling rotary machine comprising:

a stator means which comprises a first and a second coaxial member;

a plurality of identical nozzle means arranged in an axially-symmetrical configuration on said stator means, said nozzle means being spaced uniformly apart so as to form a plurality of identical flow channels between said nozzle means;

said nozzle means comprising a fixed-spacer member and an adjustable-segment member;

said fixed-spacer members being tightly fastened to, and longitudinally spaced between, said first and second coaxial members in sealing relationship thereto such that when said apparatus is in use no fluid is allowed to flow radially between the abutting surfaces of said fixed-spacer member and said first coaxial member and between the abutting surfaces of said fixed-spacer member and said second coaxial member;

said fixed-spacer member having a longitudinally extending surface;

said adjustable-segment member having a longitudinally extending surface which abuts said longitudinally extending surface of said fixed-spacer member such that said adjustable-segment member is operable to move in a straight-line direction which is at least partially radial, but inoperable to move pivotally;

said adjustable-segment member being abutted against said fixed-segment member in such a manner that said members are in essentially sealing relationship such that when said apparatus is in use essentially no fluid flows radially between said longitudinally extending surface of said adjustable-segment member and said longitudinally extending surface of said fixed-spacer member; and a means for adjusting the position of said adjustable-segment member relative to said fixed-segment member.

2. The apparatus of claim 1, wherein at least a part of said fixed-spacer member is spaced radially inward relative to said adjustable-segment member when said control apparatus is in an open position, wherein said nozzle means forms a discharge angle for fluid entry into a rotor, and wherein said discharge angle remains essentially constant for all adjustable positions of said adjustable-segment member.

3. The apparatus of claim 2, wherein said fluid-handling rotary machine is a turboexpander.

4. A fluid-handling rotary apparatus comprising:

a plurality of identical nozzle means each of which comprises a fixed-spacer member and an adjustable-segment member;

an outer cover plate;

an inner cover plate;

said fixed-spacer member being rigidly fastened to, and sandwiched in abutting relationship between, said outer cover plate and said inner cover plate in such a manner that, when said apparatus is in use, essentially no flow of fluid occurs between a first surface of said fixed-spacer member which abuts said outer cover plate and between a second surface of said fixed-spacer member which abuts said inner cover plate; and a means for adjusting the position of said adjustable-segment member relative to said fixed-spacer member, such that said adjustable-segment member is movable in a straight-line direction, without any pivotal movement.

5. The apparatus of claim 4 wherein said fixed-spacer member has a longitudinally extending planar surface, and said adjustable-segment member has a longitudinally extending planar surface, wherein said planar surfaces are abutted against each other in slideable contact, and wherein said longitudinally extending planar surfaces are parallel to said straight-line direction which said adjustable-segment member is movable.

6. The apparatus of claim 5, wherein said longitudinally extending planar surfaces are abutted in essentially sealing relationship.

7. The apparatus of claim 4 wherein said fixed-spacer member has first planar surface and a second planar surface which is parallel to and longitudinally displaced from said first planar surface, wherein said first planar surface is fastened to said outer cover plate, and wherein said second planar surface is fastened to said inner cover plate.

8. The apparatus of claim 7 wherein said adjustable-segment member has a first planar surface and a second planar surface which is parallel to and longitudinally displaced from said first planar surface thereof, wherein said outer cover plate has a planar surface which is parallel to and adjacent to said first planar surface of said adjustable-segment member, wherein said inner cover plate has a planar surface which is parallel to and adjacent to said second planar surface of said adjustable-segment member, and wherein said straight-line direction is parallel to said planar surface of said outer cover plate.

9. The apparatus of claim 8, wherein said adjustable-segment member can be adjusted over its full range of positions in a jar-free movement regardless of the flow or pressure of the working fluid.

10. The apparatus of claim 9, wherein said apparatus is designed for an entry fluid pressure to said apparatus of between about 200 and about 3000 psig, and a discharge fluid pressure from said apparatus of between about 100 and about 1500 psig.

11. The apparatus of claim 9, wherein said apparatus is designed for an entry fluid pressure to said apparatus of between about 50 and about 1000 psig, and a discharge fluid pressure from said apparatus of between about atmosphere and about 500 psig.

12. The apparatus of claim 7, wherein the thickness of said adjustable-segment member between its parallel planar surfaces is between about 0.0001 and about 0.001 inches smaller than the thickness of said fixed-spacer member between its parallel planar surfaces.

13. The apparatus of claim 7, wherein the thickness of said adjustable-segment member between its parallel planar surfaces is about 0.0002 inches smaller than the thickness of said fixed-spacer member between its parallel planar surfaces.

14. The apparatus of claim 4, wherein said nozzle means form a discharge angle for fluid to enter a rotor, and wherein said discharge angle remains essentially constant for all positions of said adjustable-segment member thereby permitting said discharge angle to be predetermined for highest operating efficiency.

15. The apparatus of claim 4, wherein said adjustable-segment members can be adjusted to essentially stop the flow of fluid through said nozzle means.

16. The apparatus of claim 4, wherein said apparatus is a turboexpander.

17. A method of recovering energy from a fluid under an elevated pressure in a turboexpander, said turboexpander comprising a stator means which comprises a first and a second coaxial member, a plurality of identical nozzle means arranged in an axially-symmetrical configuration on said stator means, said nozzle means being spaced uniformly apart so as to form a plurality of identical flow channels between said nozzle means, said nozzle means comprising a fixed-spacer member and an adjustable-segment member, said fixed-spacer members being tightly fastened to, and longitudinally spaced between, said first and second coaxial members in sealing relationship thereto such that when said apparatus is in use no fluid is allowed to flow radially between the abutting surfaces of said fixed-spacer member and said first coaxial member and between the abutting surfaces of said fixed-spacer member and said second coaxial member, said fixed-spacer member having a longitudinally extending surface, said adjustable-segment member having a longitudinally extending surface which abuts said longitudinally extending surface of said fixed-spacer member such that said adjustable-segment member is operable to move in a straight-line direction which is at least partially radial, but inoperable to move pivotally, the distance between adjacent nozzle means defining a throat distance, said throat distance being adjustable by movement of said adjustable-segment member in such straight-line direction, said adjustable-segment member being abutted against said fixed-segment member in such a manner that said members are in essentially sealing relationship such that when said apparatus is in use essentially no fluid flows radially between said longitudinally extending surface of said adjustable-segment member and said longitudinally extending surface of said fixed-spacer member, and a means for adjusting the position of said adjustable-segment member relative to said fixed-segment member, said method comprising:

(a) continuously introducing a fluid under elevated pressure into said turboexpander;

(b) adjusting said throat distance between said nozzle means to maintain a high efficiency for energy recovery from the expansion of said fluid in said turboexpander by moving each of said adjustable-segment members in a straight-line direction and without any pivotal movement relative to its corresponding fixed-spacer member so that the efficiency of recovering energy from said fluid during its expansion through said nozzle means is high; and (c) discharging said fluid, at a lower pressure than said elevated pressure, from said turboexpander.

18. The apparatus of claim 4, wherein said fixed-spacer member forms with a rotor an angle into-the-rotor for fluid to enter said rotor, and wherein said angle into-the-rotor remains essentially constant for all adjustable positions of said nozzle means thereby permitting said angle into-the-rotor to be predetermined for highest operating efficiency.

* * * * *